US005253459A

United States Patent [19]

Parinas et al.

[11] Patent Number: 5,253,459

[45] Date of Patent: Oct. 19, 1993

[54] CURTAIN WALL STURCTURE

[75] Inventors: Benigno N. Parinas, Whitby; Elio P. Toffoli, Don Mills; Jesse G. Vokey, Scarborough, all of Canada

[73] Assignee: Robertson-Ceco Corporation, Boston, Mass.

[21] Appl. No.: 720,281

[22] Filed: Jun. 24, 1991

[51] Int. Cl.[5] ..... E06B 3/54

[52] U.S. Cl. ..... 52/235; 52/397

[58] Field of Search ..... 52/235, 397, 488

[56] References Cited

U.S. PATENT DOCUMENTS 4,471,584 9/1984 Dietrich ..... 52/14

5,105,593 4/1992 Kaminaga et al. ..... 52/235

*Primary Examiner*—Carl D. Friedman

*Assistant Examiner*—Matthew E. Leno

*Attorney, Agent, or Firm*—Reed Smith Shaw & McClay

[57] ABSTRACT

A curtain wall structure assembled from modular frame assemblies and having an improved four corner joint construction of more than adequate weathertightness. Alignment means is provided for structurally connecting lower head rails in axially aligned relation. Filler strip means and lap strip means cooperate with the alignment means to cap a vertical conduit formed by interlocked mullion sections; and to seal a gap and a space presented between adjacent interlocked head and sill rails thereby providing a wearthertight four corner joint.

9 Claims, 10 Drawing Sheets

218
40C
26C
38D 204
76A
208
74A
26D
145
54A
26A
76B
34A
136
38B
147
82
54B
26B
74B
34B

CURTAIN WALL STURCTURE

BACKGROUND OF THE INVENTION

This invention relates to curtain wall structures, and more particularly to four corner joints formed between modular frame assemblies wherein a weather tight seal is assured.

Curtain wall structures are known which employ modular frame assemblies arranged in side-by-side interlocked relation and top-to-bottom interlocked relation.

In one such system there is an opening at the location where four frame assemblies meet, through which wind driven rain could enter the building. A sealant block is provided which preferably comprises a sealant impregnated foam material sold under the tradename EM-SEAL, and available from Emseal Corporation of Mississuaga, Ontario, Canada. The sealant block receives silicone caulking and is then installed over the opening in the lower modular frame assemblies and prior to the installation of the upper modular frame assemblies. On installation of the upper modular frame assemblies, the sealant block is compressed and seals the opening.

This system has several disadvantages, the most serious being the disintegration of the sealant block over an extended period of time with the result that sooner or later water penetrates into the building. During winter installations, the sealant block cools significantly and becomes rigid so that it cannot be compressed as required and a seal is not formed. In addition, the sealant block with the applied silicone caulking, impairs the drainage of the curtain wall system resulting in moisture penetration into the building.

SUMMARY OF THE INVENTION

The principal object of this invention is to provide a curtain wall structure assembled from modular frame assemblies, which will remain weathertight along the vertical and horizontal joints.

Another object of this invention is to provide a four corner joint construction which is watertight and airtight.

The present invention provides improvements in a four corner joint between first and second lower modular frame assemblies, and third and fourth upper modular frame assemblies of a curtain wall structure. Each modular frame assembly comprises head and sill rails which extend in parallel, and first and second mullion sections which extend in parallel and which are secured to opposite ends of the head and sill rails. The first and second mullion sections have mating structure allowing the first mullion section of one modular frame assembly to be slidingly interlocked with the second mullion section of an adjacent modular frame assembly in side-by-side relation. The head rails of adjacent modular frame assemblies are separated by the interlocked first and second mullion sections and present a gap therebetween. The head and sill rails have mating structure allowing the sill rail of an upper modular frame assembly to be slidingly interlocked with the head rail of a lower modular frame assembly in top-to-bottom relation.

Further in accordance with this invention, alignment means is provided which spans across the gap between the head rails of the first and second lower modular frame assemblies and structurally connects them in axially aligned relation. The adjacent head and sill rails of the first and second modular frame assemblies present spaced-apart panel receiving structures which project outboard of the alignment means and which have a space therebetween. Lap strip means is provided which spans across the space and engages the spaced-apart panel receiving structures of the first and second lower modular frame assemblies.

The adjacent head and sill rails of the lower modular frame assemblies have spaced-apart outboard and inboard upstanding walls defining an alignment channel in which the alignment means is frictionally engaged. Filler strip means disposed between the alignment means and the lap strip means, constitute a continuity of the outboard upstanding walls. The lap strip means, filler strip means and the alignment means cooperate to preclude ingress of air and moisture through the curtain wall structure.

BRIEF DESCRIPTION OF THE PREFERRED EMBODIMENT(S)

Figure 1:
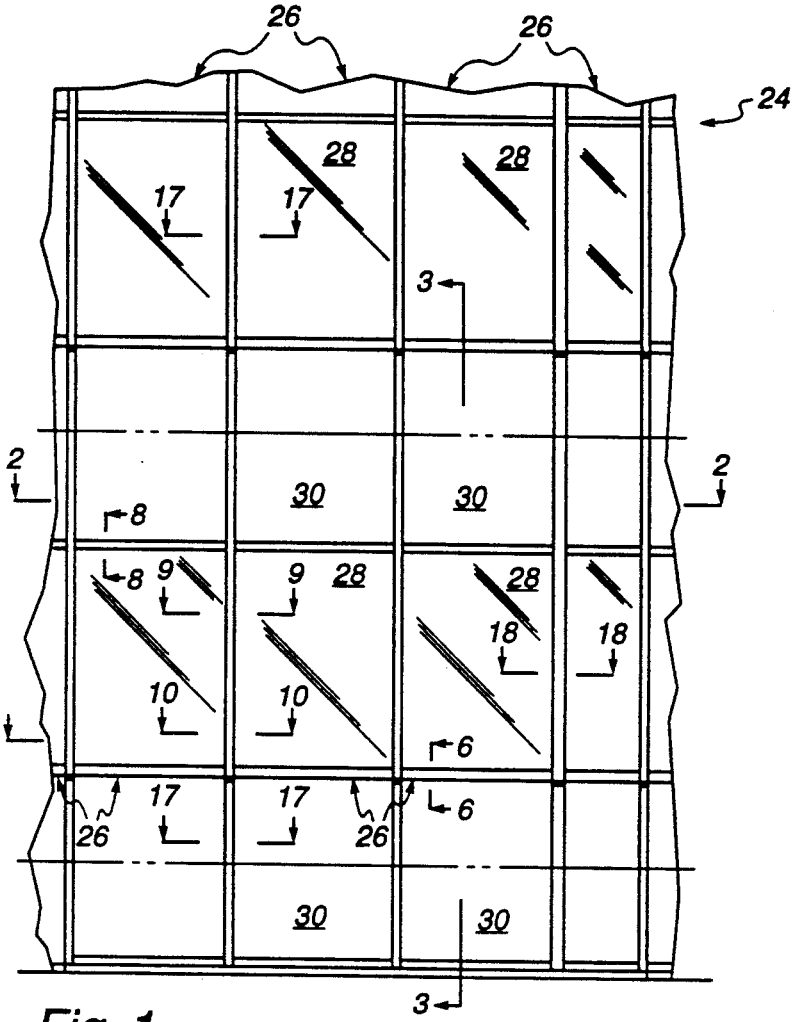
FIG. 1 is an elevation view of a curtain wall structure incorporating modular frame assemblies of this invention.
Figure 3:
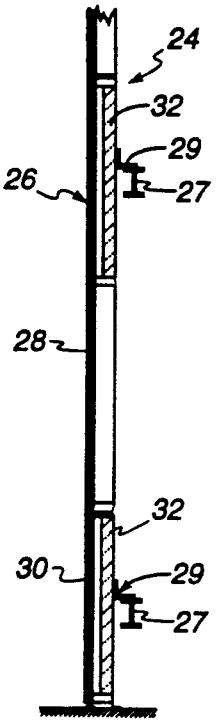
FIG. 3 is a cross-sectional view taken along the line 3—3 of FIG. 1.
Figure 2:
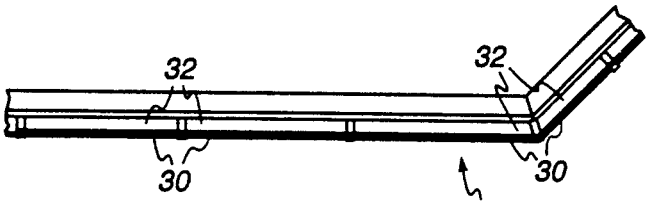
FIG. 2 is a cross-sectional view taken along the line 2—2 of FIG. 1.

FIG. 1 illustrates a curtain wall structure 24 assembled from plural modular frame assemblies 26 each supporting glazing panels 28 and infill panels 30. The infill panels 30 may comprise opaque glass panels backed by thermal insulation 32 (FIGS. 2, 3). As shown in FIG. 3, each frame assembly 26 is secured to horizontal beams 27 of a structural steel framework, by fastening means 29.

Figure 4:
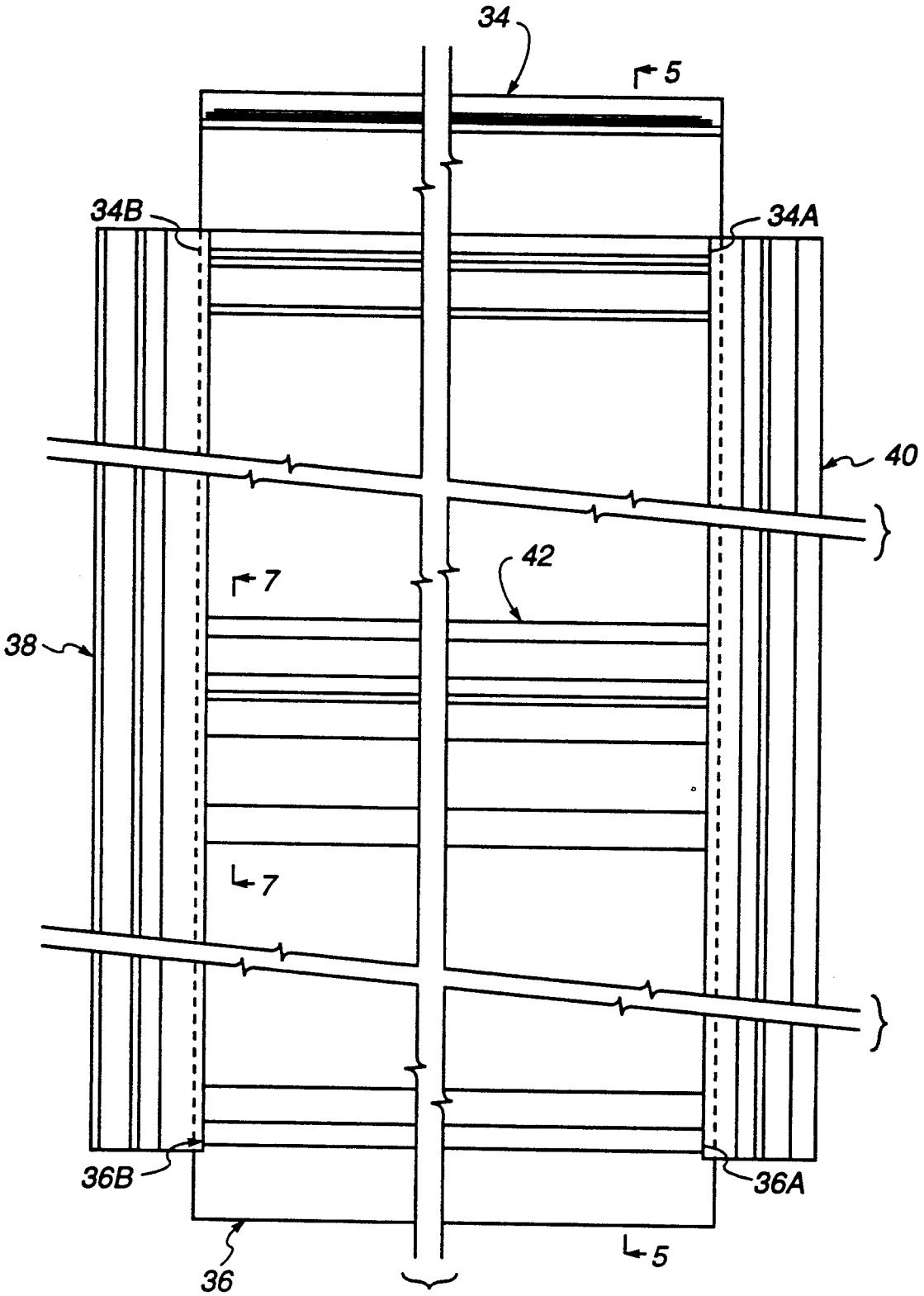
FIG. 4 is a broken elevation view of a modular frame assembly.

Each frame assembly 26 (FIG. 4) comprises a head rail 34 and a sill rail 36 extending in parallel; and first and second mullion sections 38, 40 extending in parallel and secured to the opposite ends 35A, 35B and 37A, 37B of the head and sill rails 34, 36. In this instance, an intermediate rail 42 is provided extending parallel with the rails 34, 36, and having opposite ends 42A, 42B secured to the mullion sections 38, 40.

Figure 5:
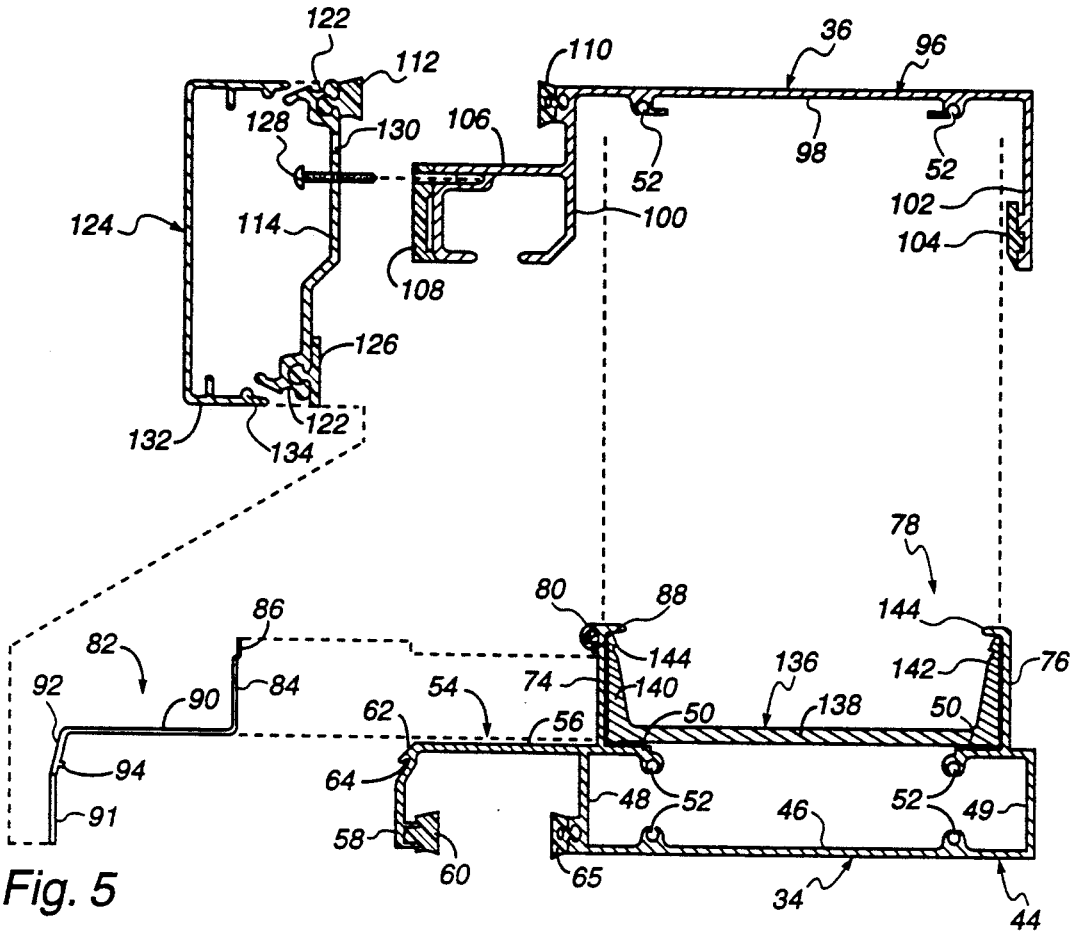
FIG. 5 is an exploded cross-sectional view taken substantially along the line 5—5 of FIG. 4 illustrating head and sill rails.
Figure 6:
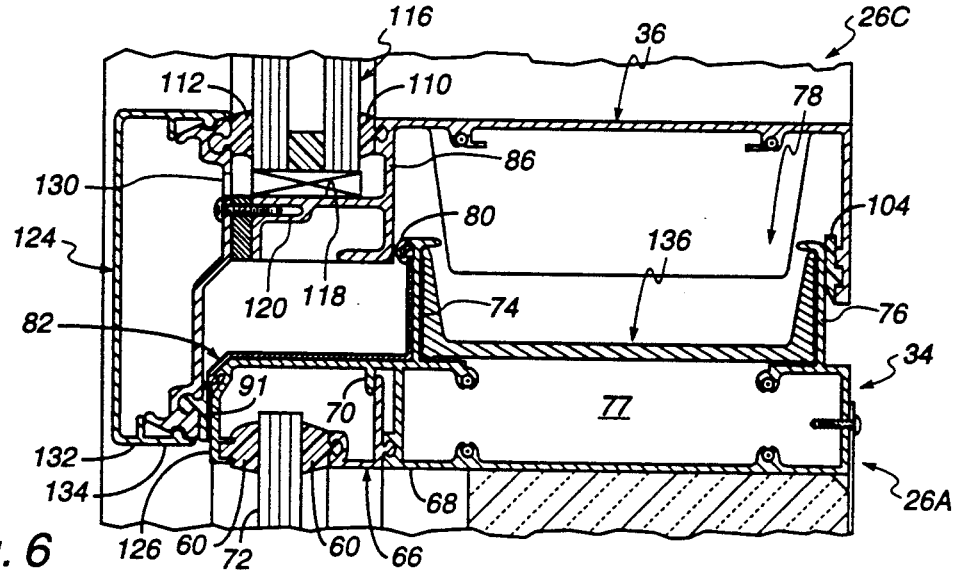
FIG. 6 is a cross-sectional view taken along the line 6—6 of FIG. 1 illustrating interlocked head and sill rails.

Referring to FIG. 5, the head rail 34 preferably is formed form aluminum by extrusion process. The head rail 34 comprises a generally U-shaped body 44 including a web 46 and opposite sides 48, 49 terminating in inturned top walls 50, 50. The web 46 and the inturned top walls 50, 50 are provided with fastening receiving grooves 52 for securing the head rail 34 to the mullion sections 38, 40. The head rail 34 presents a panel receiving structure 54 comprising a horizontal leg 56, a vertical leg 58 carrying a glazing seal 60, and an inclined leg portion 62 connecting the legs 56, 58 and having a groove 64 extending the length thereof. The side 48 presents a glazing seal 65 which cooperates with the opposed glazing seal 60 to retain a glazing panel. Alternatively, as shown in FIG. 6, a transition piece 66 carrying a glazing seal 60 cooperates with key groove 68 and a nob 70 to retain a single glass pane 72. Referring to FIG. 5, the head rail 34 additionally presents spaced-apart, outboard and inboard upstanding walls 74, 76 which cooperate with the inturned walls 50 to define an alignment channel 78 extending parallel with the head rail 34. Air-seal means 80 carried at the upper end of the outboard upstanding wall 74, serves as a primary seal in the present curtain wall structure 24.

Lap strip means 82 is provided in the form of a Z-shaped member preferably formed from plastic, such as, polyvinyl chloride by extrusion process. As will hereinafter be more fully explained, the lap strip 82 spans across a space between adjacent modular frame assemblies and seals the same. The lap strip 82 includes a vertical leg 84 terminating in an offset flange 86 of reduced thickness which is receivable in a slot 88 presented at the outer face of the outboard wall 74. The lap strip 82 additionally includes a horizontal leg 90 and a vertical leg 91 connected to the horizontal leg 90 by an inclined leg portion 92. A nib 94 on the inclined leg portion 92 is receivable in the groove 64 of the panel receiving structure 54 of the head rail 34.

The sill rail 36 includes an inverted U-shaped portion 96, including a top wall 98 and outboard and inboard depending walls 100, 102. The inboard wall 102 carries a seal member 104. A bifurcated leg 106 projects outwardly from the outboard depending wall 100 and retains a thermal separator strip 108. The outboard wall 100 carries a glazing seal 110 which cooperates with a glazing seal 112 carried by a horizontal pressure plate 114 to retain a double-pane panels 116, as shown in FIG. 6. The bifurcated leg 106 (FIG. 6) presents a ledge 118 carrying a support block 120 upon which the panel 116 rests.

It will be observed in FIGS. 5 and 6 that the head and sill rails 34, 36 have mating structure comprising the upstanding walls 74, 76 of the head rail 34 and the depending walls 100, 102 of the sill rail 36. The mating structure is such that, as shown in FIG. 6, the sill rail 36 of an upper frame assembly 26C slidingly interlocks with a lower frame assembly 26A in top-to-bottom relation. The interlocked head and sill rails 34, 36 form a horizontal conduit 77 serving a gutter.

Grooves 122 at the opposite ends of the pressure plate 114 receive and retain cap means 124 in snap-fit engaged therewith. A seal member 126 provided along the inner lower edge portion of the pressure plate 114 engages the leg 91 of the lap strip means 82 as shown in FIG. 6. Fasteners 128 (only one visible) secure the pressure plate 114 to the bifurcated leg 106. A weep hole 130 in the pressure plate 114 located above the bifurcated leg 106, cooperates with a weep hole 132 in the base leg 134 of the cap means 124 to discharge any moisture which may bypass the glazing seal 112.

As shown in FIGS. 5 and 6 and as will hereafter be more fully explained, alignment means 136 resides in the alignment channel 78 and is friction fitted between the upstanding walls 74, 76 thereof. The alignment means 136 structurally connects the adjacent modular frame assemblies in axially aligned relation. The alignment means 136 comprises a U-shaped member including a web 138 and upstanding legs 140, 142 each presenting a lengthwise nib 144 on the inner faces thereof. The purpose of the nibs 144 will hereinafter be explained.

Figure 11:
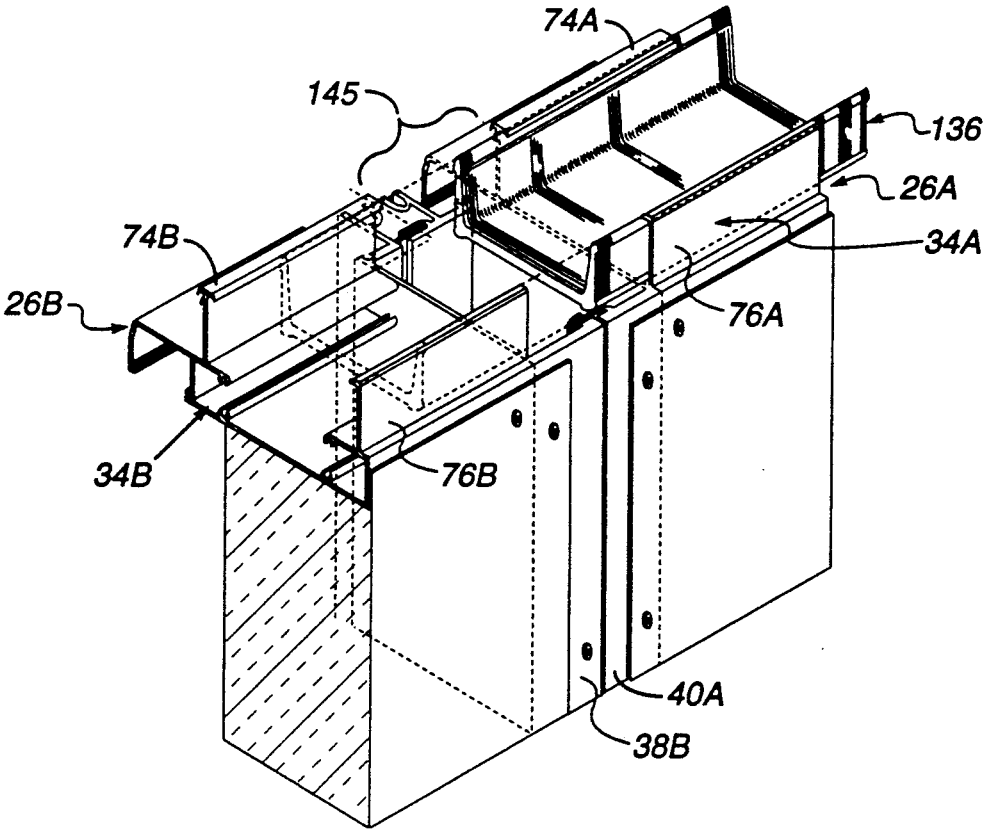
FIG. 11 is a fragmentary isometric view of adjacent lower modular frame assemblies illustrating the installation of alignment means.
Figure 14:
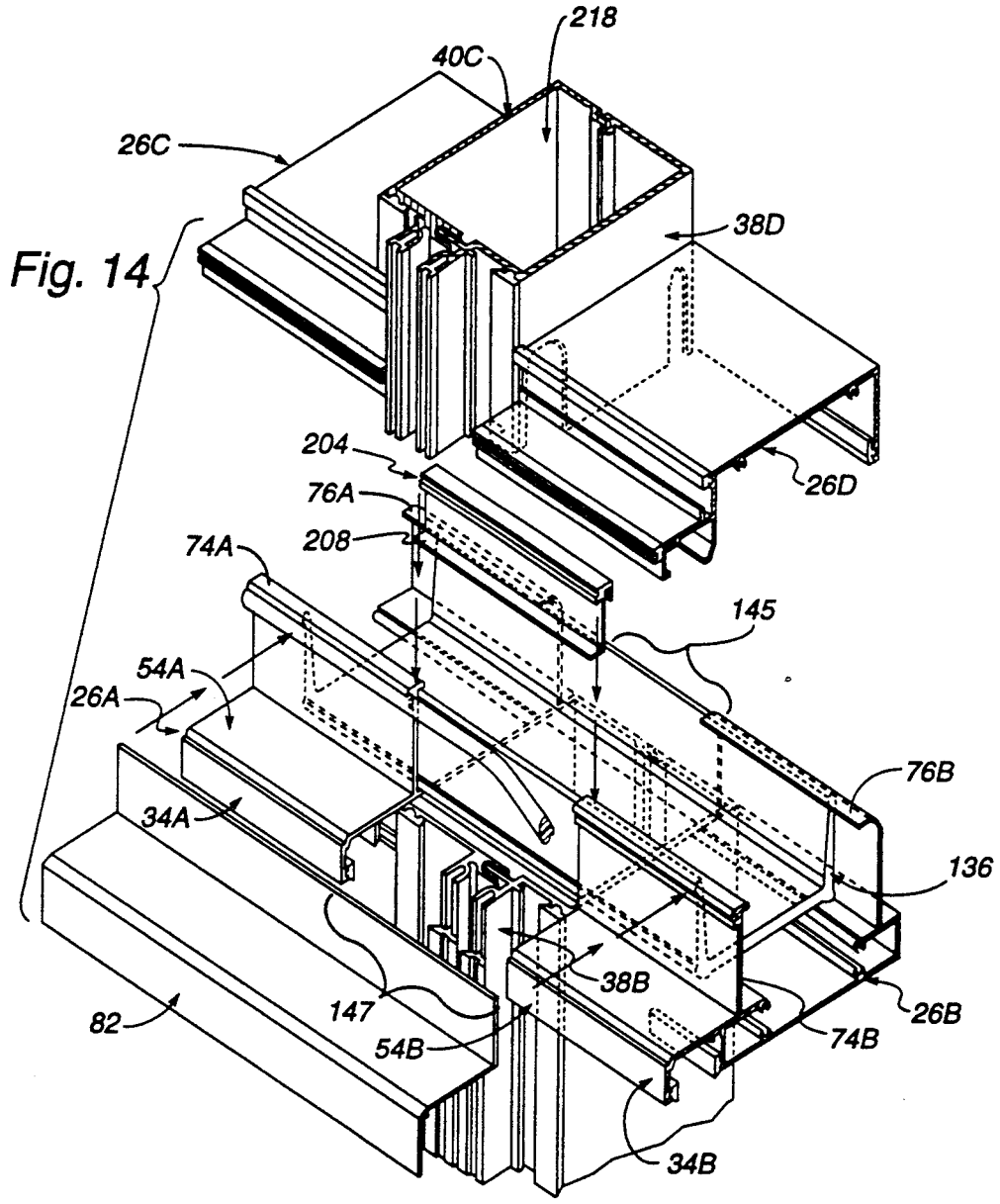
FIG. 14 is a fragmentary, exploded isometric view of a four corner joint illustrating the components thereof.

As shown in FIG. 11, the alignment means 136 is friction fitted between the upstanding walls 74A, 76A. The head rails 34A, 34B of the adjacent frame assemblies 26A, 26B are separated by the interlocked first and second mullion sections 38B, 40A and present a gap 145 therebetween. As shown in FIG. 14, the alignment means 136 spans the gap 145 and is frictionally engaged with the upstanding walls 74B, 76B of the adjacent head rail 34B. The alignment means 136 thus structurally connects the lower frame assemblies 26A, 26B in axially aligned relation.

Figure 15:
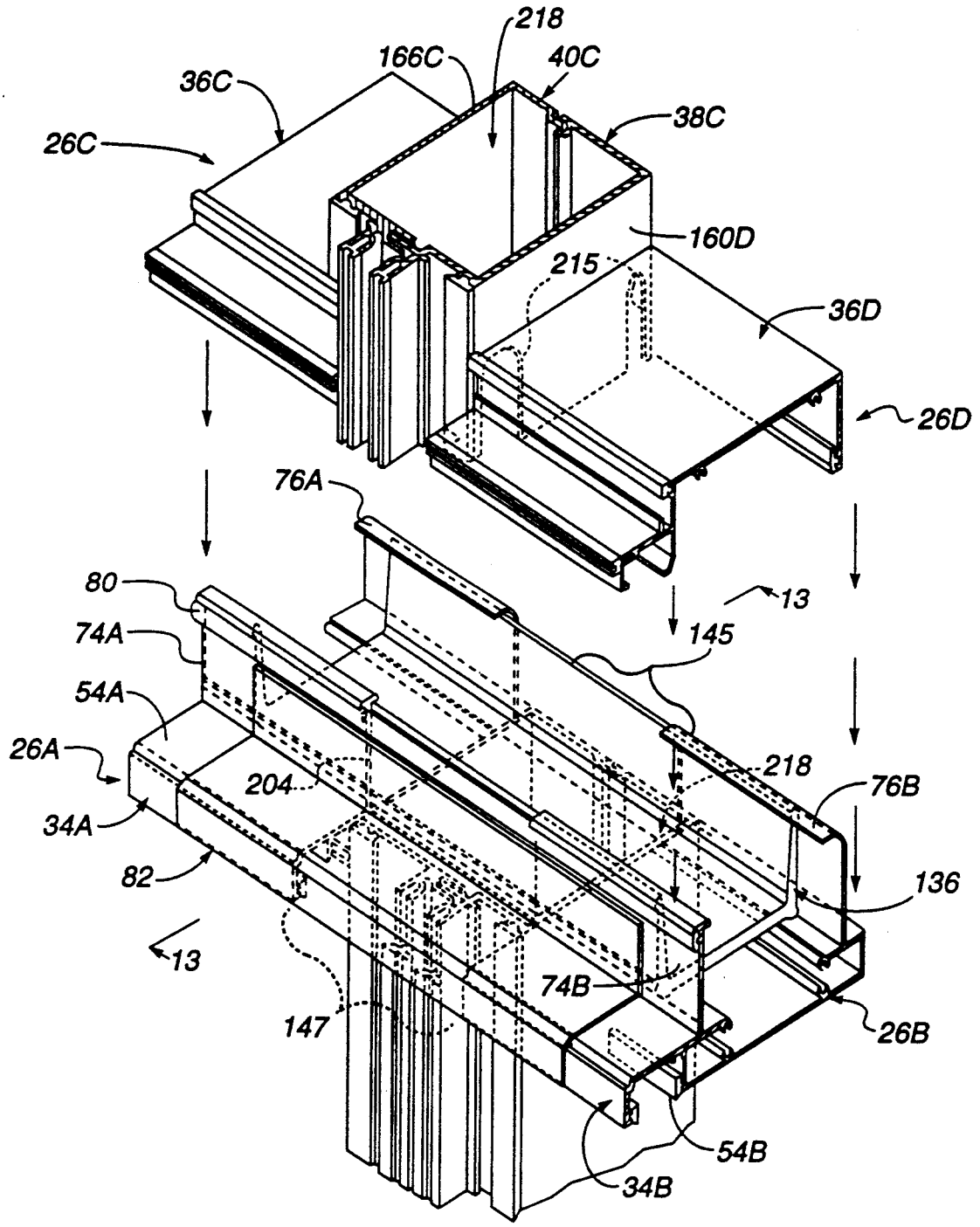
FIG. 15 is a view, similar to FIG. 14, illustrating a four corner joint just prior to the installation of the upper modular frame assemblies.

As also shown in FIG. 14, the panel receiving structures 54A, 54B of the adjacent frame assemblies 26A, 26B are separated by the interlocked first and second mullion sections 38B, 40A and have a space 147 therebetween. The space 147 will be covered and sealed on installation of the lap strip means 82, as shown in FIG. 15.

Figure 7:
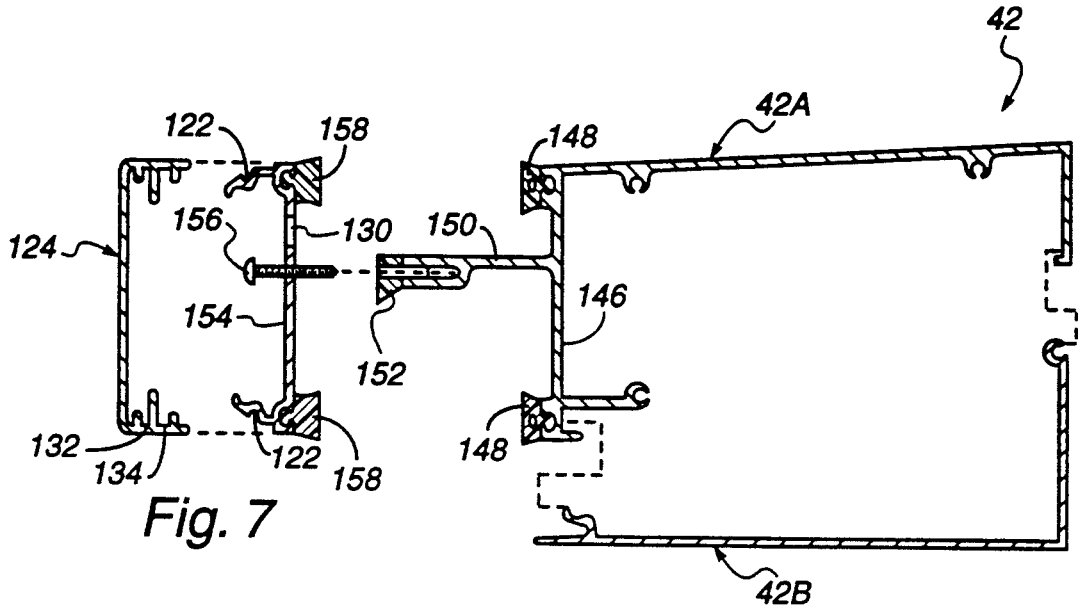
FIG. 7 is an exploded across-sectional view taken along the line 7—7 of FIG. 4 illustrating an intermediate rail.
Figure 8:
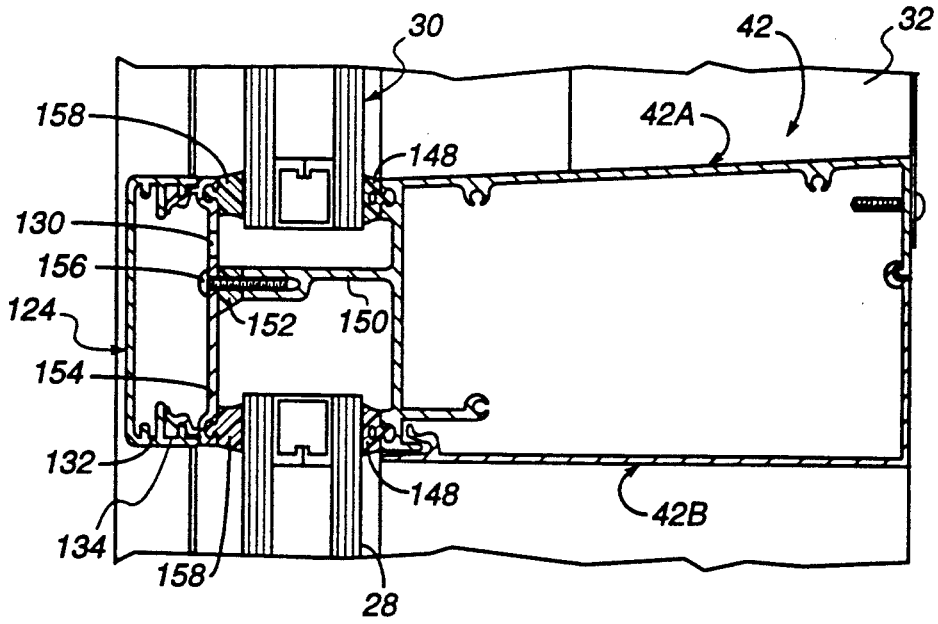
FIG. 8 is a cross-sectional view taken along the line 8—8 of FIG. 1 further illustrating the intermediate rail.

Referring to FIGS. 7 and 8, the intermediate rail 42 comprises upper and lower rail portions 42A, 42B which cooperate to provide the tubular structure of FIG. 8. A vertical leg 146 of the upper rail portion 42A carries glazing seals 148, 148 at its upper and lower ends; and has a bifurcated leg 150 projecting outwardly thereof. The bifurcated leg 150 also carries a thermal separator strip 152. A pressure plate 154 is secured to the bifurcated leg 150 by fasteners 156 (only one visible). The pressure plate 154 carries glazing seals 158, 158 which cooperate with the glazing seals 148, 148 of the intermediate rail 42 to retain the panels 28, 30, as shown in FIG. 8. The pressure plate 154 presents grooves 122 which retain the horizontal cap means 124 by snap-fit engagement. Weep hole 130 in the pressure plate 154 located above the bifurcated leg 150 and weep hole 132 in the base leg 134 of the cap means 124 serve to discharge any moisture which may bypass the glazing seals 158.

Figure 9:
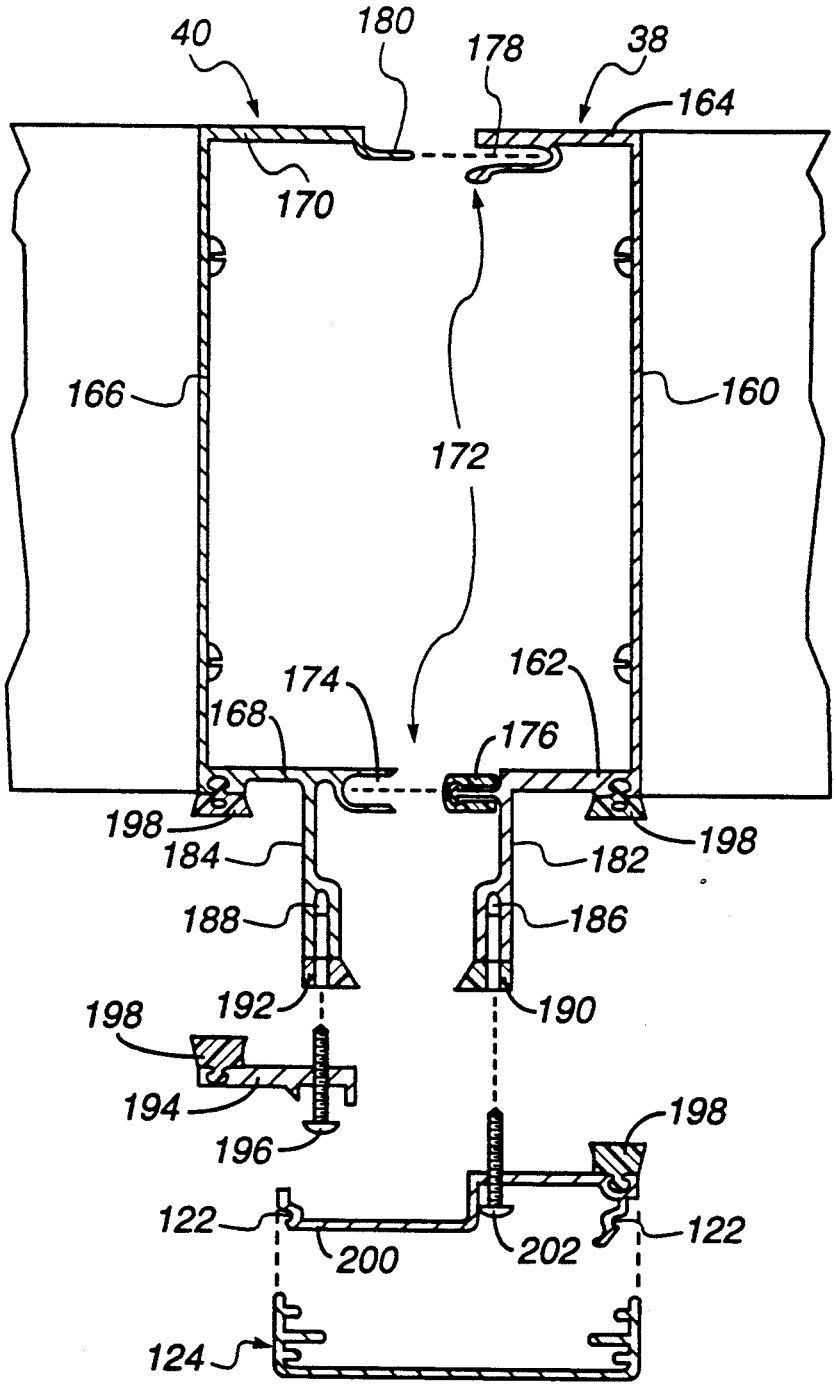
FIG. 9 is an exploded across-sectional view taken along the line 9—9 of FIG. 1 illustrating first and second mullion sections.

Referring to FIG. 9, the first mullion section 38 is generally C-shaped and includes a web 160 and laterally extending outboard and inboard legs 162, 164, respectively. The second mullion section 40 is generally C-shaped including a web 166 and laterally extending outboard and inboard legs 168, 170, respectively. The first and second mullion sections 38, 40 have mating structure 172 which includes the following. The outboard leg 168 of the second mullion section 40 presents a lengthwise vertical groove 174 receiving an air-seal gasket 176 carried by the outboard leg 162 of the first mullion section 38. The airseal gasket 176 preferably comprises a dual-durometer gasket formed from gasket material sold under the tradename Santoprene®, a proprietary product of Monsanto Chemical Co., St. Louis, Mo. The inboard leg 164 of the first mullion section 38, presents a lengthwise groove 178 which receives a lengthwise tongue 180 presented by the inboard leg 170 of the second mullion section 40. The mating structure 172 is such that, as shown in FIG. 14, the first mullion section 38D of one modular frame assembly 26D slidingly interlocks with the second mullion section 40C of an adjacent upper modular frame assembly 24C. The same is true for the adjacent lower frame assemblies 26A, 26B.

Figure 10:
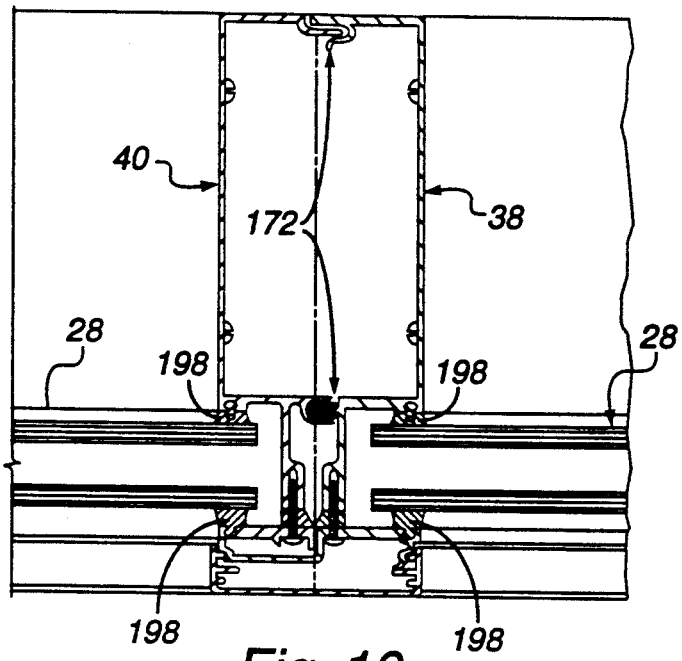
FIG. 10 is a cross-sectional view taken along the line 10—10 of FIG. 1 illustrating interlocked first and second mullion sections.

Returning to FIG. 9, the outboard legs 162, 168, present bifurcated legs 182, 184, respectively, having lengthwise slots 186, 188, receiving thermal separator strips 190, 192, respectively. The bifurcated leg 184 has a pressure plate 194 secured thereto by fasteners 196 (only one visible). The pressure plate 194 and the outboard leg 168 carry glazing seals 198, 198 which retain the glazing panels 28 (FIG. 10). The bifurcated leg 182 has a pressure plate 200 secured thereto by fasteners 202 (only one visible). Opposed glazing seals 198 provided on the pressure plate 200 and the outboard leg 162 retain the glazing panel 28 (FIG. 10). Grooves 122 at the opposite ends of the pressure plate 200 receive and retain cap means 124 by snap-fit engagement.

Figure 12:
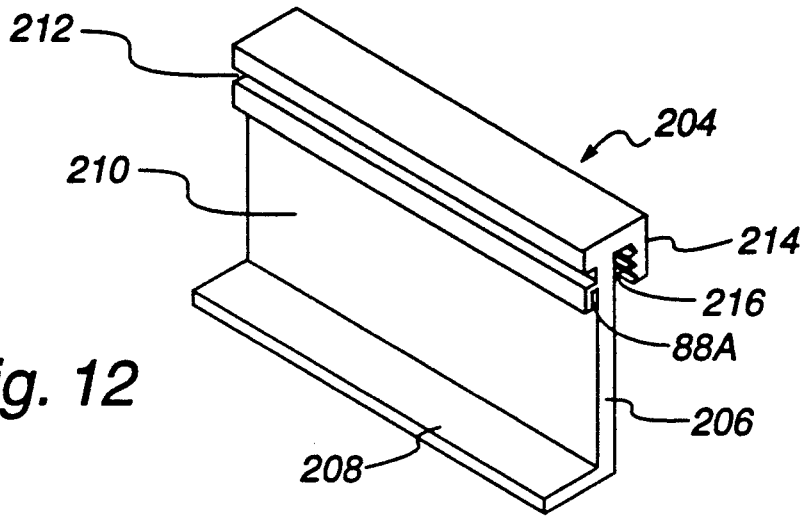
FIG. 12 is an isometric view of filler strip means.

Referring to FIG. 12, there is illustrated filler strip means 204 which is preferably formed from aluminum by extrusion process. The filler strip means 204 comprises a vertical wall 206 having a horizontal flange 208 at its lower end, which extends laterally outwardly of an outboard face 210 of the vertical wall 206, a slot 88A and a sealant receiving groove 212 at the outboard face 210. A hook 214 projects from the opposite side of the wall 206 and has a serrated interior face 216. AS seen in FIG. 14, the filler strip means 204 is installed between the adjacent outboard upstanding walls 74A, 74B of the adjacent head rails 34A, 34B and constitutes a continuity of the upstanding walls 74A, 74B.

As shown in FIG. 14, the interlocked mullion sections 38B, 40A (and the interlocked mullion sections 38D, 40C) form a vertical conduit 218 which is closed off by the alignment means 136 and the horizontal flange 208 of the filler strip means 204. Thus convection currents can only occur within the vertical conduit 218 of each modular frame assembly 26. The alignment means 136 serves the dual functions of structural connector and conduit cap. Likewise the filler strip means 204 serves the quadruple functions of constituting a continuity of the upstanding walls 74A, 74B; allowing the continuity of the air-seal gasket 80 across the gap 145; receiving and retaining the offset flange 86 of the lap strip means 82; and serving as a conduit cap.

Figure 13:
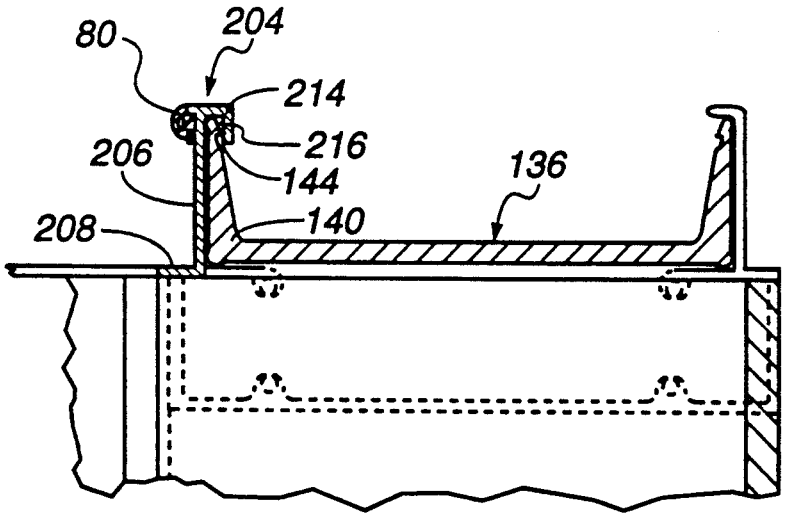
FIG. 13 is a cross-sectional view taken along the line 13—13 of FIG. 15 illustrating the filler strip means connected to the alignment means.

As shown in FIG. 13, the hook 214 fits over the upstanding leg 140 of the alignment means 136 and is retained in place by one of the serrations of the serrated interior face 216 engaging the lengthwise nib 144.

FIG. 15 illustrates the lap strip means 82 overlying the panel receiving structures 54A, 54B. Prior to installing the lap strip means 82, a silicone adhesive (not visible) is applied to the outer faces of the panel receiving structures 54A, 54B and to the outer faces of the outboard upstanding walls 74A, 74B. The silicone adhesive fixes the lap strip means 82 in position. It will be observed that the gap 145 between the adjacent head rails 34A, 34B, and the space 147 between the panel receiving structures 54A, 54B are effectively and positively sealed by the alignment means 136, the filler strip means 204 and the lap strip means 82. The sill rails 36C, 36D of the upper modular frame assemblies 26C, 26D may now be sequentially lowered and slidingly interlocked with the head rails 34A, 34B of the lower modular frame assemblies 26A, 26B. As shown in dotted outline, the web 160D of the first mullion section 38D is provided with vertical slots 215. Although not visible, the web 166 of the second mullion section 40C is also provided with similar vertical slots 215. The vertical slots 215 receive the walls 74A, 76A and 74B, 76B and thereby allow the sliding interlock of the sill rails 36C, 36D with the head rails 34A, 34B.

Figure 16:
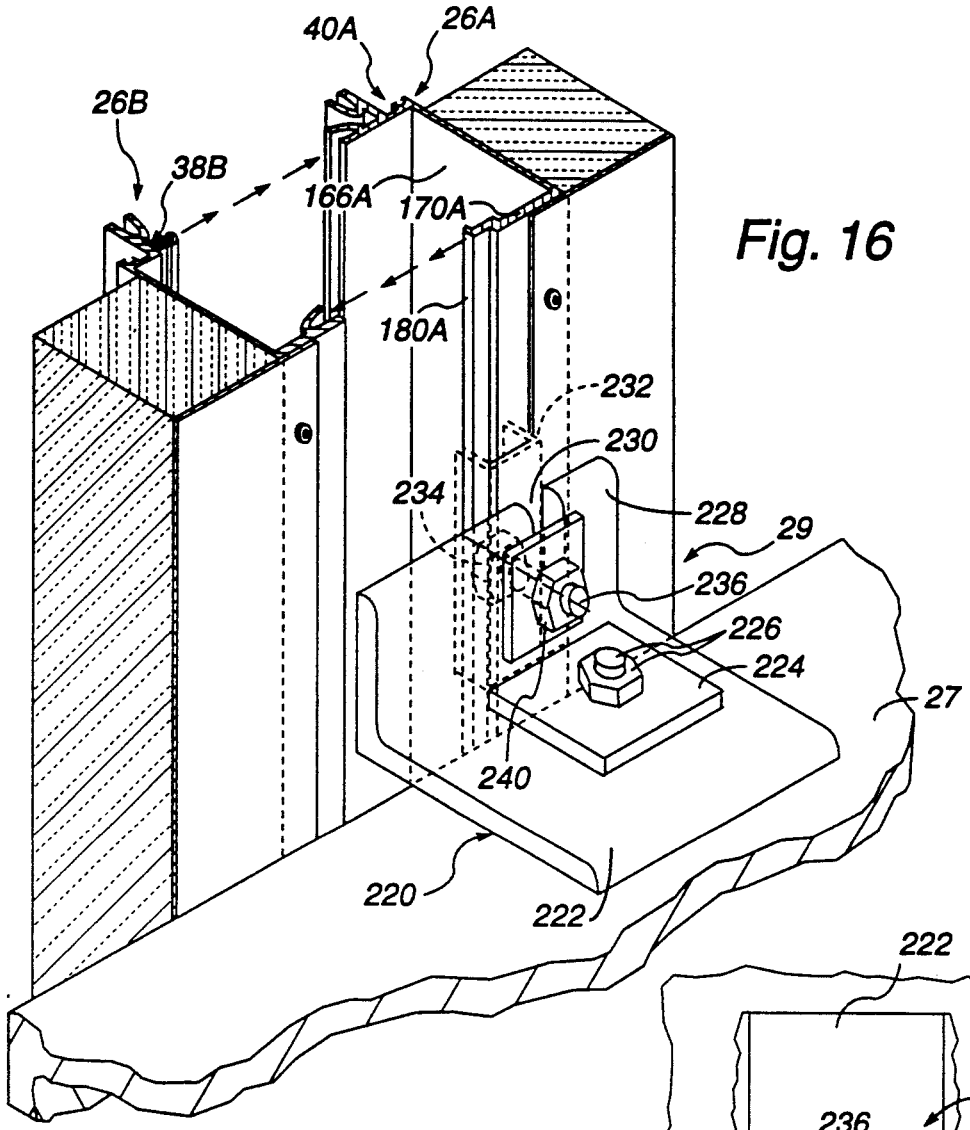
FIG. 16 is a fragmentary isometric view of fastening means securing a modular frame assembly to structural steel.
Figure 17:
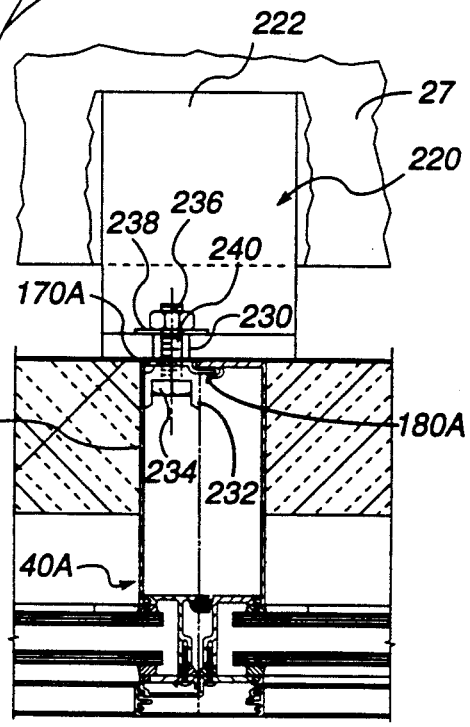
FIG. 17 is a cross-sectional view taken along the line 17—17 of FIG. 1 illustrating an alternative arrangement of the fastening means of FIG. 16.

Referring to FIGS. 1 and 16, each of the modular frame assemblies 26 requires fastening means 29 to secure the same to the horizontal beam 27. As best shown in FIG. 16, the fastening means 29 comprises an L-shaped clip 220 having a horizontal arm 222 and a vertical arm 228. The horizontal arm 222 overlies the beam 27 and is secured thereto by a fastener, such as, a washer 224 and bolt and nut 226. The horizontal arm 222 may, instead, be welded to the beam 27, as shown in FIG. 17. The vertical arm 228 is provided with a vertical slot 230. A U-shaped channel 232 is disposed within the second mullion section 40A and engages the inner face of the inboard leg 170A and is restrained between the web 166A and the tongue 180A. The channel 232 nonrotatably retains the head 234 of a fastener 23 which extends through the channel 232, the inboard leg 170A, the slot 230, a washer 238 and receives a nut 240. The arrangement allows the adjacent first mullion section 38B of the frame assembly 26B, to be slidingly interlocked with the second mullion section 40A of the adjacent frame assembly 26A.

It should be apparent from the foregoing description and the accompanying drawings that a curtain wall structure is provided, assembled from modular frame assemblies, which will remain weathertight along the vertical and horizontal joints. That the present invention provides a four corner joint construction with improved watertightness by effectively blocking all paths of moisture and air infiltration/exfiltration and thus forms an effective air seal.

We claim:

1. A four corner joint between first and second lower modular frame assemblies and third and fourth upper modular frame assemblies of a curtain wall structure comprising:

each modular frame assembly comprising a head rail and a sill rail extending in parallel, a first mullion section and a second mullion section extending in parallel and secured to opposite ends of said head rail and said sill rail;

the first and second mullion sections having mating structure such that the first mullion section of one modular frame assembly slidingly interlocks with the second mullion section of an adjacent modular frame assembly in side-by-side relation; the head and sill rails having mating structure such that the sill rail of an upper modular frame assembly slidingly interlocks with the head rail of a lower modular frame assembly in top-to-bottom relation;

the head rails of adjacent interlocked modular frame assemblies being separated by interlocked first and second mullion sections and having a gap therebetween;

alignment means spanning across said gap and between adjacent head rails of said first and second lower modular frame assemblies, structurally connecting the adjacent head rails in axially aligned relation;

said adjacent head rails each presenting spaced-apart outboard and inboard upstanding walls defining an alignment channel extending parallel with said head rails;

said alignment means having opposite ends captively retained in the alignment channels of said adjacent first and second lower modular frame assemblies;

filler strip means disposed between said alignment means and said lap strip means, and comprising a continuity of said outboard upstanding walls;

the adjacent head rails of said first and second lower modular frame assemblies presenting spaced-apart panel receiving structure projecting outwardly of said alignment means and having a space therebetween; and lap strip means spanning across said space and overlying said spaced-apart panel receiving structures of said first and second lower modular frame assemblies;

said alignment means and said lap strip means cooperating to preclude ingress of wind driven rain and moisture through said four corner joint.

2. The four corner joint as defined in claim 1 including air seal means carried at outboard faces of said filler strip means and of said outboard upstanding walls.

3. The four corner joint as defined in claim 1 wherein the interlocked first and second mullion sections form a vertical conduit capped by said alignment means.

4. The four corner joint as defined in claim 1 wherein said filler strip means includes a horizontal flange overlying said interlocked first and second mullion sections and cooperating with said alignment means to close off said vertical conduit.

5. The four corner joint as defined in claims 3 wherein the interlocked head and sill rails form a horizontal conduit serving as a gutter.

6. The four corner joint as defined in claim 5 wherein said vertical conduit communicates with said horizontal conduit.

7. The four corner joint as defined in claim 1 wherein said lap strip means comprises a generally Z-shaped member including an inboard upstanding vertical leg adjacent to said alignment means, an outboard depending vertical leg adjacent to said panel receiving structure, and a horizontal leg overlying said panel receiving structure and connecting said inboard leg to said outboard leg.

8. The four corner joint as defined in claim 7 wherein said lap strip means is formed from plastic.

9. The four corner joint as defined in claim 1 including support structure inboard of said curtain wall structure; and fastening means each securing one of said mullion sections of each modular frame assembly to said support structure.

* * * * *